US006211609B1

(12) United States Patent
Baek

(10) Patent No.: US 6,211,609 B1
(45) Date of Patent: Apr. 3, 2001

(54) CORNER SPRING FOR COLOR CATHODE RAY TUBE

(75) Inventor: Hyun-Chul Baek, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/146,076

(22) Filed: Sep. 2, 1998

(30) Foreign Application Priority Data

Sep. 3, 1997 (KR) ..... 97-45685

(51) Int. Cl.[7] ..... H01J 29/80
(52) U.S. Cl. ..... 313/404; 313/406; 313/407
(58) Field of Search ..... 313/402–408

(56) References Cited

U.S. PATENT DOCUMENTS 4,652,792 * 3/1987 Tolita et al. ..... 313/404
4,827,180 5/1989 Sone et al. .
5,012,154 * 4/1991 Ragland, Jr. ..... 313/406
5,063,325 * 11/1991 Ragland, Jr. ..... 313/405
5,072,151 * 12/1991 Spina ..... 313/407
5,502,349 * 3/1996 Seo ..... 313/404
5,557,162 * 9/1996 Han ..... 313/402
6,037,709 * 3/2000 Nakagawa et al. ..... 313/404

* cited by examiner

*Primary Examiner*—Michael H. Day
*Assistant Examiner*—Matthew J. Gerike

(57) ABSTRACT

A corner spring for color CRT includes a first arm where a coupling hole is formed to mate with a stud pin inside the panel, a second arm coupled with an outer face of the frame for supporting the shadow mask, and a welding portion where the first and second arms are welded to each other. The length(L) of movable piece that is from the welding portion to bent portion of the first arm, is represented as $1.08S \leqq L \leqq 1.75S$ to the distance (S) from a center of spring hole in a stud pin coupling portion of the first arm to a frame contacting portion of the second arm. The distance (H) between a central axis of the welding portion and the frame welding portion of the second arm is expressed as $H \leqq 0.668S$.

2 Claims, 2 Drawing Sheets

CORNER SPRING FOR COLOR CATHODE RAY TUBE

BACKGROUND OF THE INVENTION

1. Field of the Invention

The present invention relates to a color cathode-ray tube (hereinafter referred to as "CRT"). More particularly, it relates to a design compensation volume setup of a corner spring for supporting a mask structure within a panel.

2. Discussion of Related Art

As shown in FIG. 1, a conventional CRT includes a panel 2 mounted in front thereof; a funnel 7 mounted at the back of the panel 2 in order to maintain a vacuum; a neck 10 extending from the back of the funnel 7; an electron gun 8 within the neck 10, for emitting R, G, and B electron beams; a phosphor screen 3 applied to the inner surface of the panel 2, including phosphor layer for producing red, green, and blue lights in accordance with landing of electron beams; and a shadow mask structure 6 consisting of a rectangular shadow mask 4 where a plurality of electron beam apertures (not shown) are formed for color selection, and a frame 5 for fixing the shadow mask 4.

The frame 5 is supported by a corner spring 11 connected to a stud pin 12 toward the panel 2. As shown in FIG. 2, the corner spring 11 disclosed in U.S. Pat. No. 4,827,180 is constructed of a first arm 27 having a stud pin hole, and a second arm 29 connected to the frame 5, the first and second arms being welded to each other. The two, respective arms make a specific angle ($\theta_1$,$\theta_2$) with a central axis 1 of welding portion.

Reference numeral 9 is indicative of a deflection yoke for deflecting the electron beams.

In the conventional CRT, the electron beams emitted from the electron gun 8 are deflected by the deflection yoke 9, before passing through the apertures of the shadow mask 4 and scanning the phosphor screen, to thereby display an image.

The internal parts are located like a dotted line of FIG. 3 prior to operation of the CRT, but move like a solid line when the temperature rises due to heat expansion.

The mask apertures formed on the shadow mask 4 move toward P' from P, and the corner spring 11 serves to allow the mask apertures to move to a phosphorescent screen, heading for the position of Q.

That is, in this case, the V-shaped corner spring 11 is pressed to make the first and second arms 27 and 29 closer to each other. The second arm 29 is welded to the frame 5, and $\theta_1$ and $\theta_2$ of FIG. 2 is differently changed, in such a way that the position of the corner spring 11 is varied outside.

The color CRT has been developed in recent years, having the shadow mask made of the material of low coefficient of expansion such as Invar alloy, namely 36% nickel-iron alloy with coefficient of expansion of about $1.2\times10^{-6}$/° C., and the mask frame made of iron.

The shadow mask made of Invar alloy with very low coefficient of expansion, does not expand with heat, and the mask frame expands around with heat during operation of the CRT.

The typical corner spring for compensating the misland-ing by angle ($\theta_1$,$\theta_2$) of spring results in inaccurate electron beam landing. The reason why the electron beams land inaccurately is as follows.

When the temperature rises in the CRT the shadow mask does not efficiently expand with heat. The mask frame is made of iron with coefficient of expansion (about $1.2\times10^{-5}$/° C. at room temperature) about ten times as high as 36% nickel-iron alloy. In this connection, the mask frame expands with heat.

Consequently, the corner spring allows the shadow mask move toward the screen. A passage that the electron beams pass through the mask apertures is altered, which causes the electron beams to inaccurately land on the phosphor element, thereby resulting in degradation of color purity.

SUMMARY OF THE INVENTION

Accordingly, the present invention is directed to a corner spring for color CRT that substantially obviates one or more of the problems, limitations, and disadvantages of the related art.

An objective of the present invention is to provide a corner spring whose movable piece's length L is optimized to prevent the mislanding caused by heat expansion, to thereby enhance the color purity of a CRT.

Additional features and advantages of the invention will be set forth in the description which follows, and in part will be apparent from the description, or may be learned through practice of the invention. The objectives and other advantages of the invention will be realized and attained by the structure, particularly as detailed in the written description and claims hereof as well as the appended drawings.

To achieve these and other advantages and in accordance with the purpose of the present invention, as embodied and broadly described, the length L of slope of a first arm is represented as $1.08S \leqq L \leqq 1.75S$ to the distance S from a center of a stud pin coupling portion 113 to a frame contacting portion that is an end of a frame welding portion 123 of a second arm, and the distance H between a welding portion 103 where the first and second arms are welded to each other and the frame welding portion 123 of the second arm is expressed as $H < 0.668S$.

It is to be understood that both the foregoing general description and the following detailed description are exemplary and explanatory, and are intended to provide further explanation of the invention as claimed.

BRIEF DESCRIPTION OF THE ATTACHED DRAWINGS

The accompanying drawings, which are included to provide a further understanding of the invention, and are incorporated in and constitute a part of this specification, illustrate embodiments of the invention that together with the description explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
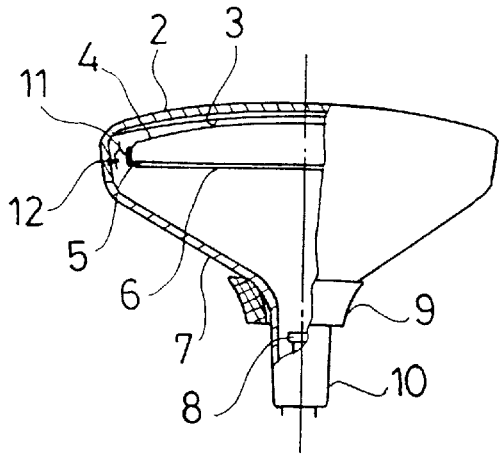
FIG. 1 Prior Art
FIG. 1 is a cross-section of part of a conventional CRT.
Figure 2:
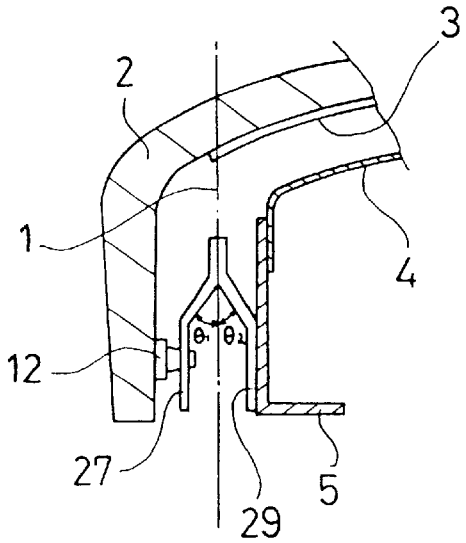
FIG. 2 Prior Art
FIG. 2 is an enlarged cross-section of corner spring of the CRT.
Figure 3:
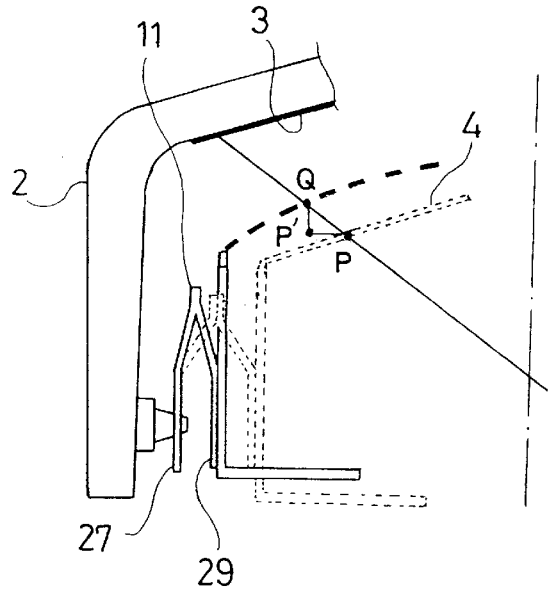
FIG. 3 Prior Art
FIG. 3 shows a changed state of the conventional corner spring.
Figure 4:
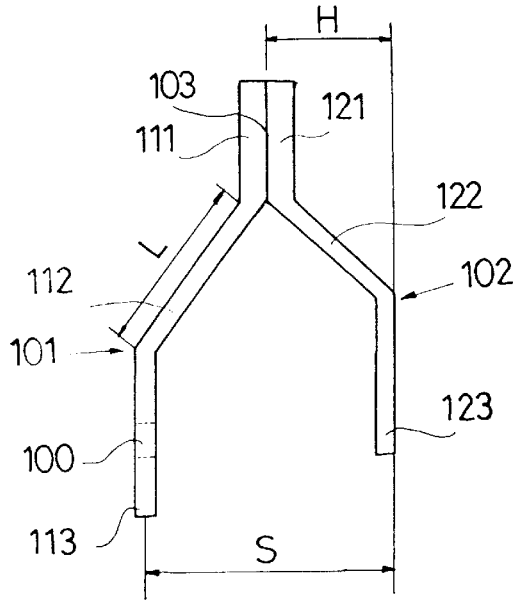
FIG. 4 depicts in detail the structure of a corner spring of the present invention.

With reference to FIG. 4, a corner spring for color CRT includes a first arm 101 where a coupling hole is formed to mate with a stud pin inside the panel, and a second arm 102 coupled with an outer face of the frame for supporting the shadow mask, the first arm 101 having a first coupling portion 111 to match with the second arm, a first slope 112 which is bent, making an obtuse angle with the coupling portion, and a stud pin coupling portion 113 which is bent, extending from the slope, with a spring hole 100 to receive the stud pin, and the second arm 102 having a second coupling portion 121 to match with the first arm, a second slope 122 which is bent, making an obtuse angle with the coupling portion, and a frame welding portion 123 which is bent, extending from the slope to be welded to the frame. The length L of slope of the first arm is represented as $1.08S < L < 1.75S$ to the distance S from a center of the stud pin coupling portion 113 to a frame contacting portion that is an end of a frame welding portion 123 of the second arm, and the distance H between a welding portion 103 where the first and second arms are welded to each other and the frame welding portion 123 of the second arm is expressed as $H < 0.668S$.

At the time of design compensation volume setup of corner spring, the length L of the first slope and the height H of the welding portion are constructed adequately. In case of reducing the first slope in length L and making coefficient of expansion high, a force applied to the stud pin is increased. Therefore, two of four corner springs mates with two stud pins, but it is hard to manually attach two remaining corner springs because of extremely high, mechanical strength of spring. In case of increasing the first slope in length L, when an impact is applied, the corner spring arranged within the panel may be detached from the stud pin, and apparatus interference may occur within the panel, to cause scratch and bad parts.

The welding portion of the second arm, that decreases in height H, may result in over compensation. The compensation volume exceeds a certain range, to apply an interference to panel stud pin at the time of mounting/detaching the mask structure.

In this connection, the length L of the first slope lies in $12 \leqq L \leqq 23$ mm($1.08S < L < 1.75S$), to prevent the spring from being detached due to external impact. Therefore, the spring can be easily mounted on/detached from the stud pin manually. In addition, the height H of the welding portion of the second arm exceeds the range of $H \leqq 8.0$ mm($H \leqq 0.668S$), which applies an interference to the stud pin when mounting/detaching the mask structure. The design of corner spring is to be made, depending on the L and H.

As described above, the corner spring of the present invention has a construction that allows adequate compensation volume. Thus, the mounting/detaching operation of the mask structure is effectively performed as compared to prior art, to thereby increase productivity of goods. The expansion of CRT mask by heat is adequately compensated to greatly alleviate purity drift volume, thereby producing an excellent image.

It will be apparent to those skilled in the art that various modifications and variations can be made in a corner spring for color CRT of the present invention without departing from the spirit or scope of the invention. Thus, it is intended that the present invention cover the modifications and variations of this invention that come within the scope of the appended claims and their equivalents.

What is claimed is:

1. A corner spring for color CRT comprising:

a first arm having a coupling hole formed therethrough for mating with a CRT front panel stud pin; and a second arm adapted to be coupled with an outer face of a shadow mask frame, said first arm including a first coupling portion, a first slope portion which is bent relative to said first coupling portion so as to make an obtuse angle with said first coupling portion, and a stud pin coupling portion which is bent relative to said first slope portion, extending from said first slope portion, said stud pin coupling portion including said coupling hole formed therethrough, said second arm including a second coupling portion coupled with said first coupling portion of said first arm, a second slope portion which is bent relative to said second coupling portion so as to make an obtuse angle with said second coupling portion, and a frame welding portion which is bent relative to said second slope portion, extending from said second slope portion and being adapted to be coupled with a shadow mask frame, wherein a length (L) of said first slope portion is $1.08S \leqq L \leqq 1.75S$ relative to a distance (S) from a center of stud pin coupling portion to said frame welding portion, and a distance (H) between a location where said first and second coupling portions are coupled to each other and said frame welding portion is expressed as $H \leqq 0.668S$ relative to said distance S.

2. The corner spring as claimed in claim 1, wherein said length (L) is $12 \leqq L \leqq 23$ mm, and said distance (H) is $H \leqq 8.0$ mm.

* * * * *